US005358277A

United States Patent [19]

Klement, Jr.

[11] Patent Number: 5,358,277

[45] Date of Patent: Oct. 25, 1994

[54] SKI POLE ASSEMBLY WITH SCRAPER

[76] Inventor: Ronald J. Klement, Jr., 1441 S. 58th St., West Allis, Wis. 53214

[21] Appl. No.: 94,843

[22] Filed: Jul. 20, 1993

[51] Int. Cl.[5] ..... A63C 11/24

[52] U.S. Cl. ..... 280/813; 280/824

[58] Field of Search ..... 280/809, 813, 816, 819, 280/824

[56] References Cited

U.S. PATENT DOCUMENTS

| | | | |
|---|---|---|---|
| D. 193,149 | 7/1962 | Bond | 280/824 |
| 2,912,707 | 11/1959 | Fulton | 15/105 |
| 3,350,111 | 10/1967 | Sahlein et al. | 280/813 |
| 3,866,931 | 2/1975 | Marker | 280/820 |
| 3,976,304 | 8/1976 | Lillibridge et al. | 280/813 |
| 4,000,909 | 1/1977 | Coale | 280/813 |
| 4,129,312 | 12/1978 | Loffelholz | 280/824 |
| 4,573,710 | 3/1986 | Ford | 280/813 |
| 4,718,138 | 1/1988 | Brown et al. | 280/813 |

FOREIGN PATENT DOCUMENTS

| | | | |
|---|---|---|---|
| 232416 | 3/1964 | Austria | 280/824 |
| 3335017 | 4/1984 | Fed. Rep. of Germany | 280/813 |
| 2580511 | 10/1986 | France . | |
| 75641 | 9/1949 | Norway | 280/813 |

*Primary Examiner*—Richard M. Camby

*Attorney, Agent, or Firm*—Andrus, Sceales, Starke & Sawall

[57] ABSTRACT

A ski pole assembly includes a pole and a snow head/-scraper mounted toward the lower end of the pole. The snow head/scraper is in the form of disc-like member defining an upper surface and a lower surface, with a peripheral edge extending therebetween. The peripheral edge includes a substantially flat, planar surface. The intersection between the substantially flat, planar surface and one of the surfaces of the snow head/-scraper member defines a substantially linear scraping edge, which is used by a skier to scrape snow from the sole of the skier's boot.

8 Claims, 1 Drawing Sheet

FIG. 1
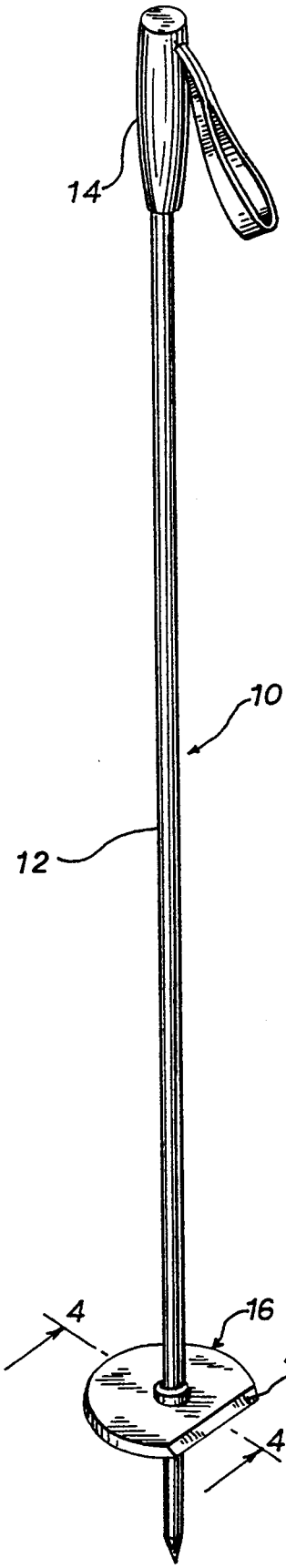
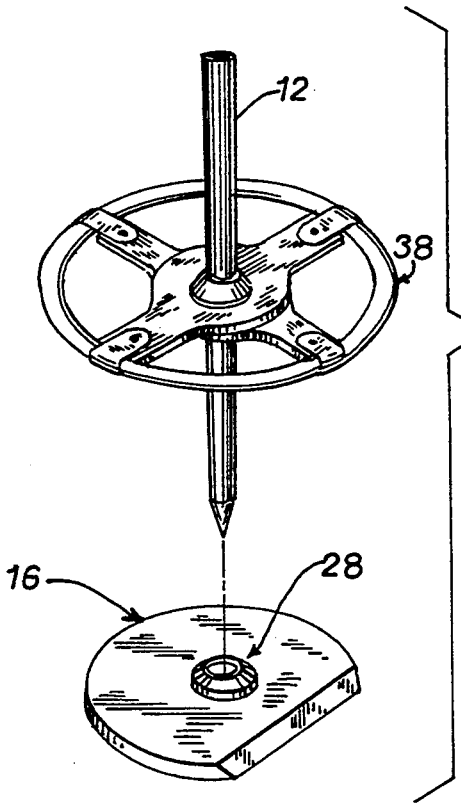
FIG. 2
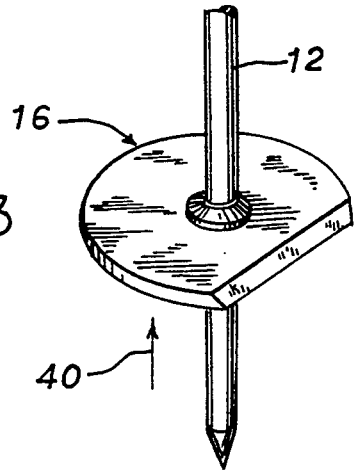
FIG. 3
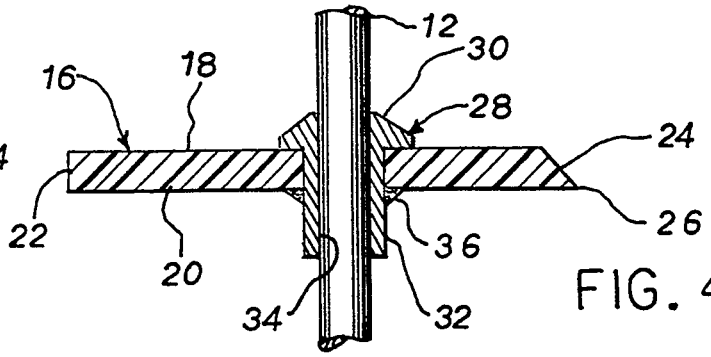
FIG. 4

SKI POLE ASSEMBLY WITH SCRAPER

BACKGROUND AND SUMMARY

This invention relates to a ski pole, and more particularly to a ski pole having a feature for scraping or cleaning a skier's boots.

In skiing, it is not unusual for snow to accumulate on the sole of a skier's boot. This affects the interface between the boot and the ski binding, and accordingly snow must be removed from the sole of the boot before the boot can be properly inserted in the binding. In the past, snow from a skier's boot has been removed using knives and hand scrapers, which must be carried by the skier and which can be misplaced or cause injury to the skier if the skier falls while carrying such devices.

Several issued patents disclose scrapers mounted to a ski pole, which facilitates transportation of the scraper. For example, pole-carried scraper devices are disclosed in Ford U.S. Pat. No. 4,573,710; Lillibridge et al U.S. Pat. No. 3,976,304; Coale U.S. Pat. No. 4,000,909; and Norwegian Patent 75,641.

It is an object of the present invention to provide a ski pole-mounted scraper which is simple in construction and the manner in which it is mounted to the ski pole. It is a further object of the invention to provide such a scraper which functions efficiently and effectively to remove snow from a skier's boot, yet which does not adversely affect the performance, weight or overall construction of the ski pole.

In accordance with the invention, a ski pole assembly consists of an elongated pole defining an upper end and a lower end, and a snow head mounted adjacent the lower end of the pole. The snow head defines a peripheral edge which includes a substantially linear transverse scraping edge oriented perpendicularly to the longitudinal axis of the pole. The snow head is preferably in the form of a flat, disc-like member defining an upper surface and a lower surface, and the transverse scraping edge is defined by a flat planar surface, forming a part of the peripheral edge, extending between the upper and lower surfaces of the disc-like member. The flat planar surface is preferably disposed at an angle non-perpendicular to the upper and lower surfaces of the disc-like member, and is angled inwardly in a bottom-to-top direction so as to define a substantially linear scraping edge at the juncture of the flat planar surface and the lower surface of the disc-like member. The snow head further includes a mounting hub to which the disc-like member is mounted, with the mounting hub defining an internal passage perpendicular to the longitudinal axis of the pole through which the pole extends.

The invention further contemplates a method of making a ski pole assembly by mounting a combination snow head/scraper member thereto, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view illustrating a ski pole assembly incorporating the snow head/scraper member constructed according to the invention;

FIG. 2 is a partial isometric view showing a conventional basket mounted to the ski pole prior to mounting of the snow head/scraper member of the invention to the ski pole;

FIG. 3 is a partial isometric view showing mounting of the snow head/scraper member of the invention to the ski pole; and FIG. 4 is a section view taken along line 4—4 of FIG. 1.

DETAILED DESCRIPTION OF THE INVENTION

Referring to FIG. 1, a ski pole assembly 10 generally includes an elongated pole 12 extending along a longitudinal axis between upper and lower ends. A conventional handle 14 is mounted to the upper end of pole 12, and a combination snow head/scraper 16 is mounted to the lower end of pole 12.

Referring to FIGS. 1 and 4, snow head/scraper 16 is in the form of a planar, disc-like member defining an upper surface 18, a lower surface 20, and an arcuate edge 22 extending between upper surface 18 and lower surface 20. Edge 22 includes a flat, planar surface 24. A linear scraping edge 26 is defined at the intersection of lower surface 20 and planar surface 24.

Planar surface 24 is oriented at an angle of approximately 45° relative to upper and lower surfaces 18, 20 of snow head/scraper 16.

A mounting hub 28 having an upper head 30 and a depending tubular wall 32 is mounted within an opening defined by snow head/scraper 16. An internal passage 34 extends through hub 28, and the lower end of pole 12 extends through and is received within passage 34. In a conventional manner, the lower end of pole 12 tapers so as to increase in diameter in a bottom-to-top direction. Passage 34 through hub 28 is straight, and accordingly engagement between the lower end of pole 12 and the internal wall of hub 28 defining passage 34 results in secure mounting of snow head/scraper 16 to pole 12.

Head 30 of hub 28 is of a diameter permitting the underside of head 30 to engage upper surface 18 of snow head/scraper 16. Tubular wall 32 extends through the opening in snow head/scraper 16, and an adhesive 36 is disposed between wall 32 and lower surface 20 of snow head/scraper 16 to secure hub 28 thereto. In addition, an adhesive may be provided between the underside of head 30 and upper surface 18 of snow head/scraper 16 to further reinforce the mounting of 28 to snow head/scraper 16.

Snow head/scraper 16 is in the shape of a circular disc, having a segment removed to define planar edge surface 24. The opening in snow head/scraper 16 through which hub 28 extends is located substantially centrally within the circular area defined by snow head/scraper 16 as if the segment of the circular disc removed to define planar edge surface 24 were in place.

Snow head/scraper 16 is preferably formed of a tough, light weight thermoplastic material such as nylon or the like. Hub 28 is constructed of suitable metal material.

Snow head/scraper 16 can either be mounted as original equipment to ski pole assembly 10, or can be retrofit onto a ski pole by removing an existing basket from the ski pole and replacing it with snow head/scraper 16. Referring to FIG. 2, a conventional ski pole includes a basket assembly 38. The user first removes basket 38 from the lower end of ski pole 12, and subsequently inserts the lower tip of ski pole 12 into and through passage 34 defined by snow head/scraper hub 28. Referring to FIG. 3, snow head/scraper 16 is moved upwardly in the direction of arrow 40 onto the lower end of ski pole 12, which results in engagement between the outer surface of ski pole 12 and the internal wall of hub 28 defining passage 34, as explained previously, to mount snow head/scraper 16 to ski pole 12.

In operation, ski pole assembly 10 functions as follows. When a skier has an accumulation of snow on his or her boot, the skier lifts the boot so as to expose its sole, and the skier then places scraping edge 26 against the sole of his or her ski boot. Using a back-and-forth motion along the longitudinal axis of pole 12, the user moves snow head/scraper 16 and its scraping edge 26 along the surface of the ski boot sole so as to remove snow accumulated thereon. Scraping edge 26 is located at lower surface 20 of snow head/scraper 16, such that the majority of snow removal occurs upon the downward stroke of ski pole 12, which further functions to reinforce engagement between hub 28 and pole 12. The angle of flat surface 24 accommodates a certain amount of wear of scraping edge 26 before having to replace snow head/scraper 16.

It is understood that snow head/scraper 16 could take a shape other than the substantially circular shape as shown and described. For example, snow head/scraper 16 could be elliptical or teardrop-shaped, while maintaining a flat, planar transverse surface such as 24 and a scraping edge such as 26, to provide a function substantially identical to that of snow head/scraper 16 as described.

Various alternatives and embodiments are contemplated as being within the scope of the following claims particularly pointing out and distinctly claiming the subject matter regarded as the invention.

I claim:

1. A ski pole assembly, comprising:

an elongated pole defining an upper end and a lower end; and a snow head mounted adjacent the lower end of the pole, the snow head comprising a substantially flat disc-like member defining an upper surface, a lower surface, and a substantially uninterrupted outer peripheral edge which includes a substantially linear transverse scraping edge oriented substantially perpendicular to the longitudinal axis of the pole, wherein the transverse scraping edge is defined by the juncture of one of the upper and lower surfaces with a substantially continuous surface which extends between the upper and lower surfaces of the disc-like member.

2. The ski pole assembly of claim 1, wherein the snow head further includes a mounting hub to which the disc-like member is mounted, the mounting hub defining an internal passage substantially parallel to the longitudinal axis of pole through which the pole extends.

3. The ski pole assembly of claim 1, wherein the transverse scraping edge is defined by the juncture or a substantially flat planar surface, which extends between the upper and lower surfaces of the disc-like member, with one of the upper and lower surfaces of the disc-like member.

4. The ski pole assembly of claim 3, wherein the substantially flat planar surface is disposed at an angle non-perpendicular to the upper and lower surfaces.

5. A ski pole assembly, comprising:

an elongated pole defining an upper end and a lower end; and a snow head mounted adjacent the lower end of the pole, the snow head comprising a substantially flat disc-like member defining an upper surface, a lower surface, and a peripheral edge which includes a substantially linear transverse scraping edge oriented substantially perpendicular to the longitudinal axis of the pole, wherein the transverse scraping edge is defined by a substantially flat planar surface extending between the upper and lower surfaces of the disc-like member and disposed at an angle non-perpendicular to the upper and lower surfaces, and wherein the substantially flat planar surface is angled inwardly in a bottom-to-top direction so as to define a substantially linear scraping edge at the juncture of the substantially flat planar surface and the lower surface of the disc-like member.

6. A combination snow head/scraper member for use with a ski pole defining upper and lower ends, comprising a rigid, one-piece disc-like member defining an upper surface, a lower surface, and a peripheral outer edge extending between the upper and lower surfaces, the peripheral outer edge including a substantially planar transverse scraper portion, wherein the intersection of the planar transverse scraper portion with one of the upper and lower surfaces defines a substantially linear scraping edge for use in scraping a skier's boots or the like, and mounting means for mounting the disc-like member to the pole adjacent the lower end of the pole.

7. A method of making a ski pole assembly, comprising the steps of:

providing a disc-like snow head/scraper member defining an upper surface, a lower surface, and a peripheral edge extending between the upper and lower surfaces, the peripheral edge including a substantially flat, planar transverse scraper portion extending between the upper and lower surfaces, wherein the snow head/scraper member includes a hub member defining a passage;

providing a ski pole defining upper and lower ends, wherein the lower end of the pole is tapered so as to increase in transverse dimension in a bottom-to-top direction; and mounting the snow head/scraper member to the ski pole adjacent its lower end by inserting the lower end of the pole through the passage and engaging the hub member with the pole by moving the snow head/scraper member in a bottom-to-top direction so as to engage the tapered lower end of the pole with the internal walls of the hub member defining the passage.

8. The method of claim 7, wherein the ski pole includes a basket, and further comprising the step of removing the basket prior to mounting the snow head/scraper member to the ski pole.

* * * * *